US006578333B1

(12) United States Patent
Gagliano

(10) Patent No.: US 6,578,333 B1
(45) Date of Patent: Jun. 17, 2003

(54) INTEGRATED PRECAST FOOTINGS

(76) Inventor: Richard J. Gagliano, 8607 58th Ave., N.W., Gig Harbor, WA (US) 98332

( * ) Notice: Subject to any disclaimer, the term of this patent is extended or adjusted under 35 U.S.C. 154(b) by 294 days.

(21) Appl. No.: 09/651,899

(22) Filed: Aug. 30, 2000

(51) Int. Cl.[7] ..... E02D 27/50; E04G 11/00

(52) U.S. Cl. ..... 52/295; 52/155; 52/426; 52/699; 249/34; 405/230

(58) Field of Search ..... 405/227, 229, 405/230, 231; 249/33, 34, 38, 39, 40; 52/155, 169.9, 294, 295, 424, 425, 426, 565, 742.14, 699, 700, 701

(56) References Cited

U.S. PATENT DOCUMENTS

| | | | | |
|---|---|---|---|---|
| 979,474 | A | | 12/1910 | Goldsborough |
| 1,238,384 | A | | 8/1917 | Blumenthal |
| 1,334,053 | A | | 3/1920 | Reynolds |
| 1,407,196 | A | | 2/1922 | Johnson |
| 1,732,341 | A | | 10/1929 | McPherson |
| 1,808,633 | A | | 6/1931 | Carver |
| 2,001,719 | A | | 5/1935 | Greene |
| 2,251,775 | A | * | 8/1941 | Arrighini |
| 2,610,380 | A | * | 9/1952 | Pollman |
| 2,614,311 | A | * | 10/1952 | Shook |
| 2,661,517 | A | * | 12/1953 | Findley |
| 2,826,281 | A | | 3/1958 | Johnson |
| 2,964,145 | A | | 12/1960 | Clatfelter |
| 3,216,159 | A | | 11/1965 | Rooker |
| 3,378,968 | A | * | 4/1968 | Shoemaker |
| 3,524,322 | A | | 8/1970 | Pogonowski |
| 3,572,044 | A | | 3/1971 | Pogonowski |
| 3,969,852 | A | * | 7/1976 | Krings |
| 4,659,256 | A | * | 4/1987 | Bullivant |
| 4,706,921 | A | | 11/1987 | Paulin |
| 4,767,241 | A | | 8/1988 | Wells |
| 5,011,336 | A | | 4/1991 | Hamilton et al. |
| 5,039,256 | A | | 8/1991 | Gagliano |
| 5,120,162 | A | * | 6/1992 | Parker |
| 5,145,291 | A | | 9/1992 | Bullivant |
| 5,174,083 | A | * | 12/1992 | Mussell |
| 5,395,184 | A | * | 3/1995 | Gagliano |
| 5,399,050 | A | * | 3/1995 | Jacobus |
| 5,406,758 | A | * | 4/1995 | Baum |
| 5,586,416 | A | * | 12/1996 | Hess, III et al. |
| 5,830,378 | A | * | 11/1998 | Butler |
| 5,884,439 | A | * | 3/1999 | Hess, III et al. |
| 5,910,087 | A | * | 6/1999 | Carter |

FOREIGN PATENT DOCUMENTS

| | | | | |
|---|---|---|---|---|
| AU | 199220 | * | 2/1958 | ..... 52/294 |
| DE | 665988 | | 5/1936 | |
| FR | 1080764 | | 12/1954 | |
| FR | 1089334 | * | 3/1955 | ..... 52/426 |
| GB | 243956 | | 12/1925 | |
| IT | 600168 | * | 11/1959 | ..... 52/294 |

* cited by examiner

*Primary Examiner*—Robert Canfield
(74) *Attorney, Agent, or Firm*—Morgan, Lewis & Bockus, LLP

(57) ABSTRACT

A low impact foundation system requiring little or no excavation, and allowing for the preservation of the soil and drainage characteristics of the site upon which it is erected. The system utilizes small obliquely driven piles in combination with a pre-cast component designed to engage a standard foundation wall.

4 Claims, 3 Drawing Sheets

INTEGRATED PRECAST FOOTINGS

FIELD OF THE INVENTION

The present invention generally relates to apparatus and methods for the support of surface structures. More specifically, the present invention provides improved pre-cast footing components configured for integration with the wall element of traditional foundations to create minimally intrusive foundation systems.

BACKGROUND OF THE INVENTION

The construction of surface structures invariably involves the preliminary task of building a foundation to support the structure. Most foundations prepared in current practice are comprised of a load bearing base known as a footing which is site poured with a cementious material into an excavation substantially below grade. The excavation provides for the footing to be founded on competent bearing soils beneath regional frost lines. Once cured, forming boards and a grid of internal reinforcing are constructed on top of the footing, allowing for the subsequent pouring of a cementious material to form a wall rising out of the excavation to a desired height above grade.

The impetus to install foundations that have minimal environmental impact has become prevalent in many areas. The effects of site manipulation on undisturbed soil are permanent and not restricted to the individual sites on which they occur. "Improving" a site with the use of large machinery, extensive excavation and fill techniques, and the altering of drainage patterns and water tables damages the biological make up, structural integrity, and pre-existing drainage characteristics of the specific and surrounding soils. This in turn can have damaging effects "downstream," where the accumulation of unwanted eroded material in streambeds can alter plant and animal habitat. Man-made structures designed to replace the storage and filtering function of previously undisturbed soils by capturing unwanted drain waters and releasing them slowly back to the stream systems, can starve the watershed of its historic flow patterns, again causing damage to the environment and water quality.

Innovation in foundation design and construction must consider not only low environmental impact, but economical construction that is adaptable to the widest possible range of architectural typologies. For low impact construction systems to have significant effects toward improving the environment and ensuring the sustainability of our population and its building techniques, their use must be widespread and quickly adoptable into the mainstream of current development practice.

U.S. Pat. No. 5,039,256 discloses systems that rectify many of the environmental problems discussed above. The disclosure of U.S. Pat. No. 5,039,256 is hereby incorporated by reference. The present invention expands on the objectives disclosed in U.S. Pat. No. 5,039,256 and provides a low impact footing system that can be integrated directly with traditional foundation walls, thereby eliminating the traditional and separate subsurface footing. The resulting foundation uses less material than traditional foundation assemblies, and is more easily implemented on site by construction personnel.

OBJECTS AND SUMMARY OF THE PRESENT INVENTION

An object of this invention is to provide an improved foundation system that incorporates pre-cast load bearing components.

An object of this invention is to provide an improved foundation system implementing traditional leveling techniques including step down configurations of the foundation sill.

An object of this invention is to provide an improved foundation system that avoids the need for special wood framing techniques in the construction of the surface structure to correct for a sloping foundation sill.

An object of this invention is to provide a new method for constructing structural foundations which is applicable to a wide variety of site and soil conditions and architectural typologies.

An object of this invention is to provide a new method for constructing structural foundations which utilizes pre-cast components light enough for the installer to carry and position on site.

An object of this invention is to provide a new method for constructing structural foundations which utilizes pre-cast components that have seating tabs designed for the specific placement of standard wall forms.

Another object of this invention is to provide a foundation which is applicable for uniformly or non-uniformly distributed loading conditions, and concentrated or point loading conditions.

Another object of this invention is to provide a foundation which is applicable for retaining wall load conditions.

Another object of this invention is to provide a foundation which is applicable for decorative cementious wall applications, supporting their own weight.

A further object of this invention is to provide a method for constructing a foundation system which will require substantially less or no site excavation for above grade buildings.

A further object of this invention is to provide a method of constructing a foundation system without significantly damaging or altering the moisture content, drainage characteristics, biological make-up, or structural integrity of the soil which it engages.

It is also an object of this invention to provide a foundation system which has parts that are easily maintained and/or replaced.

It is also an object of this invention to provide a foundation system which can be applied repeatedly as a standardized construction component with a specific load bearing capacity, and structural function.

The above and other objects of the present invention are realized in a pre-cast component comprised of four basic parts which in combination with a traditional foundation wall form a hybridized foundation system integrating driven pile, pre-cast component, and poured in place cementious wall technologies. Specifically, the pre-cast or (prefabricated) components are used in combination with driven piles and the above grade wall component of a traditional foundation. The current invention is constructed at grade without any (or in some cases only a very minimal) excavation. The series of pre-cast components contain openings with sleeves for receiving obliquely driven piles, and a central passageway within which a traditional foundation wall component is engaged. The piles, which reach to the appropriate soil bearing strata described above, are driven through the sleeves in the pre-cast components at angles and to depths determined by specific loading criteria. The pre-cast component is comprised of two halves separated by a predetermined distance relative to the width of the traditional foundation wall it is to engage. These two halves are held at this predetermined separation by the driving sleeves, which are in turn held in their respective positions by the pre-cast material of the two halves. The sleeves are further restricted in this position by a reinforcing element that engages both them and the pre-cast halves at once. The resulting assembly provides a structure for the positioning of the piles, and, in concert with them, becomes a load bearing element, that when used in series, can be integrated with a traditional foundation wall. When properly aligned and spaced according to the loading criteria of the structure to be supported, the series of integrative pre-cast footings, ("IPF") provides a framework for the placement of the lower horizontal members of the foundation wall reinforcing grid, for the erection of foundation formwork, and for the subsequent site pouring of a cementious material for the wall.

In concert, the entire assembly provides a low impact foundation, installed without, or with only minimal, excavation. The base of the intended surface structure is attached to the top (sill) of the resulting foundation using any appropriate conventional connection method. Once attached, the surface structure will rest directly on the formed foundation, transferring its loads through the wall and its engaged pile based, pre-cast footing components into the bearing soils below. The entire assembly is also applicable to both retaining and decorative foundation wall applications. The grouping of obliquely driven piles in specific, geometric configurations and their relationship to the pre-cast footings integrated into a continuous foundation wall according to a specific alignment and spacing relates directly to the loading characteristics and capacity of the system. The present invention, through its engineered design, ensures that these relationships remain fixed, allowing the entire assembly to resist gravitational, lateral, and uplifting forces in accordance with the demands at each installation.

The foregoing features of the present invention are more fully described from the following detailed discussion of a specific illustrative embodiment thereof, presented herein below in conjunction with the accompanying drawings.

DETAILED DESCRIPTION OF THE PREFERRED EMBODIMENTS

First, briefly in overview, the present invention is directed to an improved non-invasive integrated foundation system. The invention is a structural combination that uniquely allows for the integration of pile based, pre-cast components with the wall component of a common foundation to form a low impact system installed with little or no excavation. In the following discussion of the drawings of preferred embodiments, like numerals are used to indicate common elements provided in the various views. The words "standard" and "traditional" are used to indicate items in the figures which are already used in practice by the trade and are not unique to this disclosure.

Figure 1:
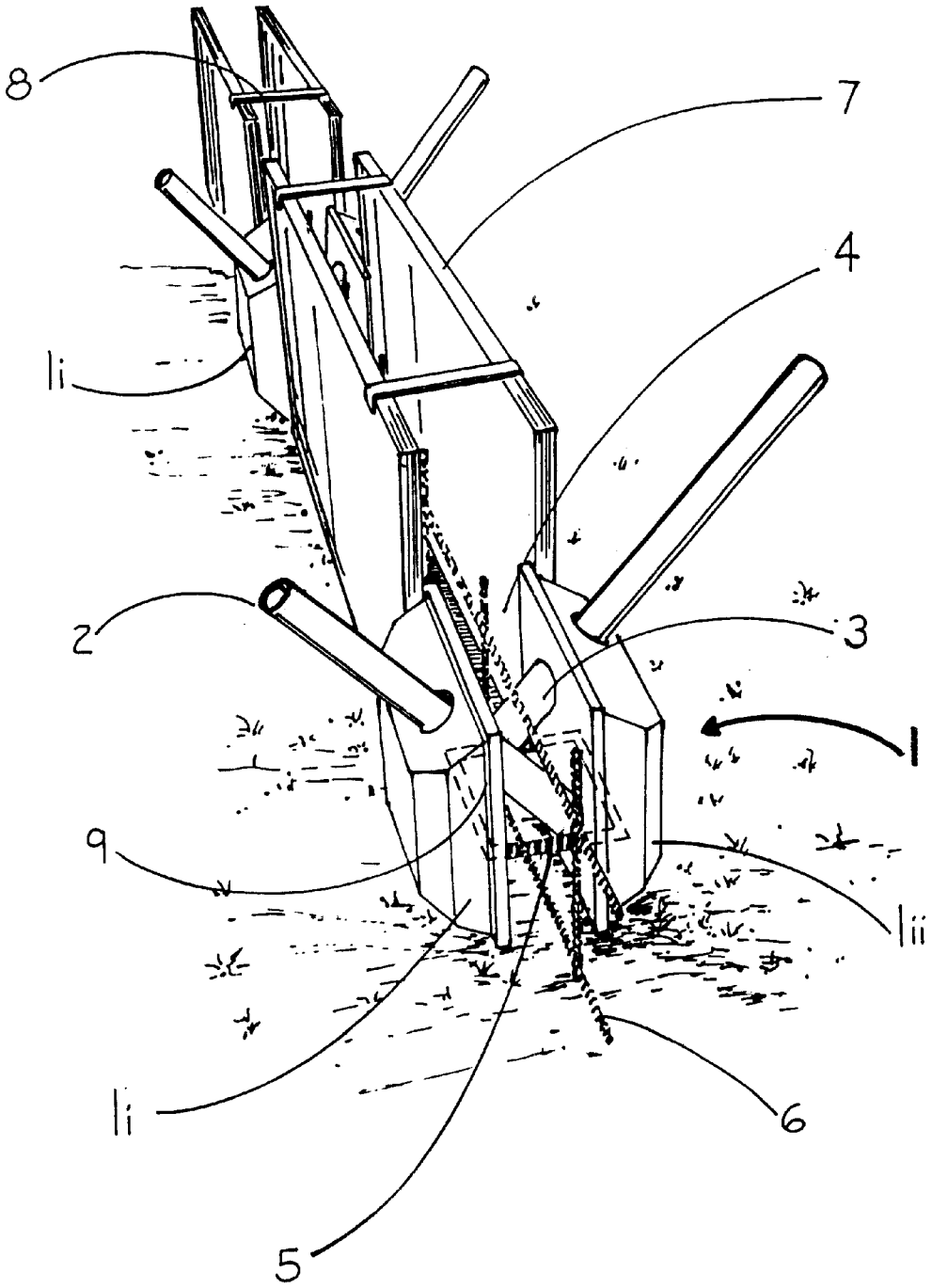
FIG. 1 is a perspective view of a portion of the pre-cast components arranged in series, and providing for the positioning of driven piles, common reinforcing grid, and standard cementious wall forms. The cementious material that forms the traditional wall component has not yet been poured.

FIG. 1 shows a perspective view of two of the pre-cast components arranged in series, and providing for the positioning of driven piles, common reinforcing grid, and standard cementious wall forms. The cementious material that forms the traditional wall component has not yet been poured. The pre-cast component 1, is comprised of two halves labeled 1i and 1ii. The separation of these halves is specific to the desired width of the subsequent wall that the component will engage. The passageway 4 that the two halves create allows for this subsequent wall to be fully engaged with the pre-cast components.

The passageway further allows for a considerable reduction in the weight of the pre-cast component, and allows for the continuity of the standard reinforcing grid 6 which runs through it. In some applications, pre-cut sections of this reinforcing grid may be pre-set within the passageway by any number of fixing means prior to the placement of the pre-cast components on site.

The pre-cast components contain sleeves 3 located between and passing through corresponding pre-cast halves, 1i & 1ii. The sleeves contain upper (entry) and lower (exit) openings for the placement and engagement of driven piles 2. Further, the pre-cast components contain a reinforcing element 5 which acts to retain the lower ends of the sleeves under the spreading force of downward loads, and further acts to provide a seat for the placement of the lower horizontal members of the reinforcing grid 6.

In this figure of the preferred embodiment, the reinforcing element is comprised of standard steel reinforcing bar similar to the reinforcing grid, and fashioned in a continuous hoop shape which encircles the lower ends of the sleeves. It may, however, be any appropriate alloy or material or shape suitable to perform its specified function. The element 5 further provides for the rigid, pre-determined width separation of the pre-cast halves, 1i & 1ii, and also acts to improve the bond between the halves and the subsequent cementious pour through the passageway 4.

The piles 2 are shown partially driven. They are utilized at this stage in the erection of the assembly to fix the pre-cast components in their position on the terrain and relative to each other. They are not yet providing their full structural function. They may remain in this partially driven position during the subsequent pour of the cementious wall, or they made be fully driven prior to the pour once the standard wall forms 7 and their corresponding standard cleats 8 are set. These wall forms are positioned between the pre-cast components and are seated against pre-cast tabs 9 along the edges of the components. These tabs 9 are positioned and sized to provide an appropriate spacing of the opposing forms specific to standard site-poured cementious wall widths.

Figure 2:
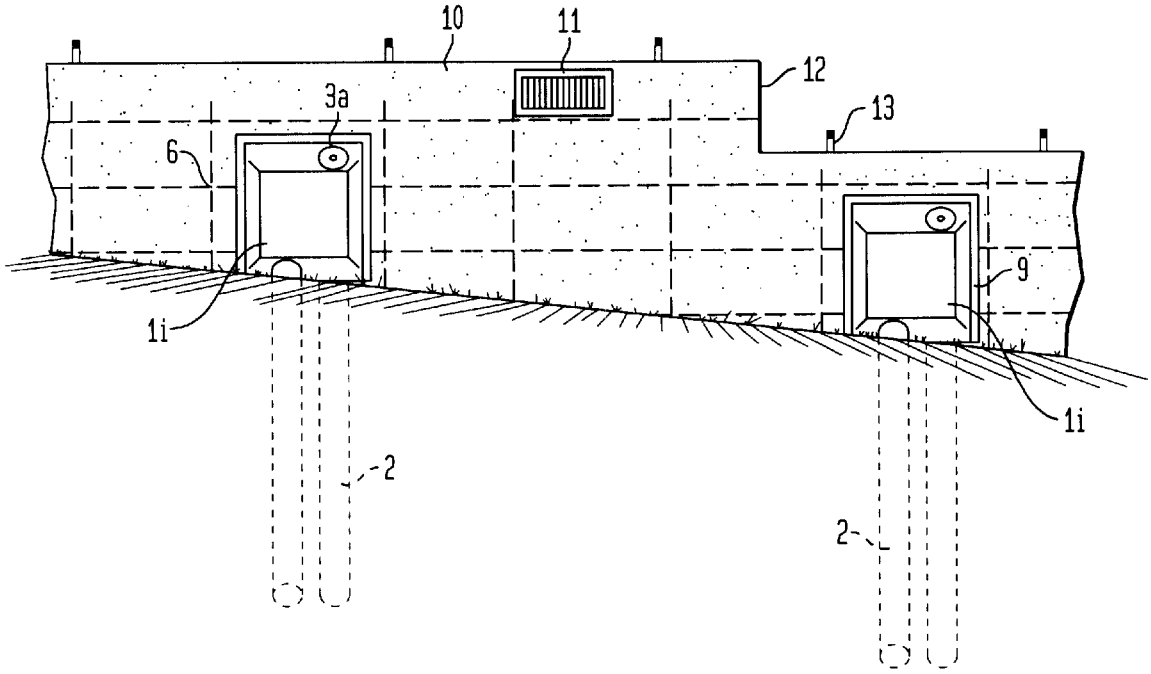
FIG. 2 is a front view of a portion of the preferred assembly of FIG. 1 now fully integrated with the piles fully driven and the engaged traditional cementious wall cast and its forms removed. The completed foundation assembly follows a sloping terrain, and the wall component employs many of the standard features of a traditional cementious foundation wall.

Other types of wall forms than those shown may be substituted in order to create the cementious wall, and the form seat tabs may be altered to accommodate these variations. The standard wall forms 7 are retained from spreading at their base in a common way with the use of cleats 8, (not shown on the bottom edges of the forms), or by the placing of wooden or steel stakes along the outer lower edge of the form (not shown). For wall pours higher than the top of the pre-cast components, (as seen in FIG. 2) metal pans are slipped in between the wall forms in the space above the components, or smaller sections of the form material shown are cut to size and fitted in the same location. This would prevent the subsequent cementious material that is poured on site from oozing out over the tops of the pre-cast components. (Pans and/or smaller form sections not shown).

The spacing of the pre-cast components 1 themselves is predetermined according to the structural loading requirements of the structure to be supported or retained. More particularly, for surface structures such as a building, individual pre-cast components are placed at specific spacings along the proposed structure forming a foundation perimeter that corresponds to the floor dimensions of the ensuing structure. More frequent spacing will result in a higher load capacity. Similarly, the diameter and length of the driven piles will effect the capacity of the system in a variety of soil types—larger diameter and/or longer piles having greater capacity. In combination, the pre-cast components 1 and the driven piles replace the traditional footing component of a standard foundation and eliminate the need for digging. The assembly, as shown, is set at grade without excavation.

FIG. 2 shows a front view of a portion of the preferred assembly now fully integrated with the piles fully driven and the engaged traditional cementious wall cast and its forms removed. The pre-cast elements 1i & 1ii (only one half, 1i, showing) are now an integral part of the site poured cementious wall 10. In combination with the now fully driven piles 2, they comprise the base load bearing elements or "footings" of the foundation system. The wall 10 will not transfer loads from the structure above to the soft loose soils at grade directly below it, but instead, will transfer its loads to the integrated pre-cast footings (IPFs). The wall spans from IPF to IPF, and is engaged with each IPF via the reinforcing grid 6 and the continuity of the poured cementious material.

The completed foundation assembly follows a sloping terrain, and the wall component provides many of the desirable features of a traditional cementious foundation. The top of the wall is level in relation to the sloping ground, and a standard step down 12 is utilized. A foundation vent 11 is installed, and standard anchor bolts 13 are used. In fact, any of the foundation wall embedments found in current practice in the trade may be utilized as though the wall component was entirely traditional.

The pre-cast components have caps 3*a* which covers the upper opening of the embedded sleeves and their corresponding driven piles. The caps may be removed to gain access to the pile for inspection. A weakened or otherwise problematic pile may be removed and replaced via the opening in the upper end of the sleeve, and the cap replaced. This cap is made of a rubberized polymer or any suitable material.

It is preferable that the pre-cast components are cast as a cementitious material, but other load bearing materials are acceptable, such as metals, thermoplastics, composites, or other materials. Similarly, the traditional wall is preferably poured on site with a cementious material, but it is possible that other materials may be used without departing from the spirit of the invention. The wall component may also be pre-cast in sections itself, separate from the pile based components, and integrated with them in the field. Numerous shapes of pile based, pre-cast components would satisfy the requirements of this invention.

Figure 3:
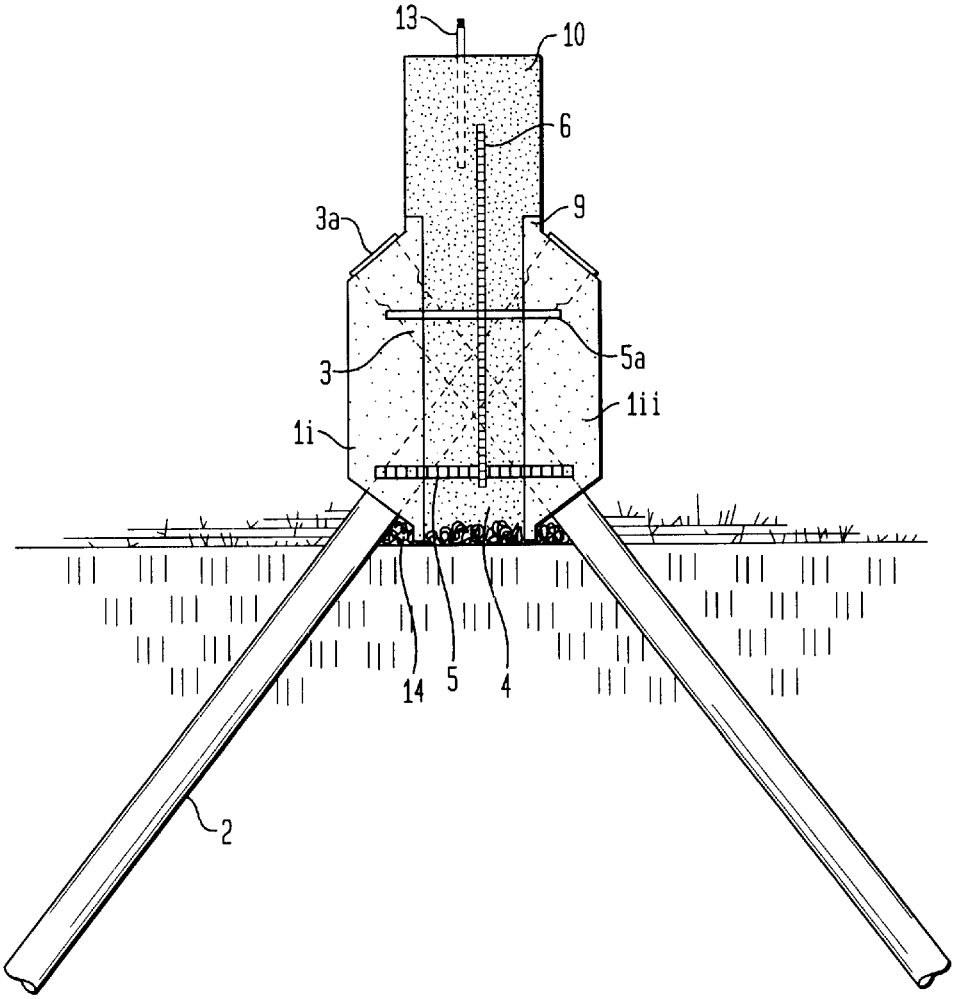
FIG. 3 is a section view of the preferred completed foundation assembly.

FIG. 3 shows a section view of the preferred completed foundation assembly. The site-poured traditional cementious wall 10 is shown in its position relative to the pre-cast component halves 1i & 1ii, and their corresponding sleeves 3 and driven piles 2. The wall fills the pre-cast component passageway 4 and engages the reinforcing grid 6. It further surrounds the sleeves 2, and the reinforcing element 5. An optional upper reinforcing element 5*a* is also shown. This element may provide a similar function to its lower counterpart, encircling now the upper ends of the sleeves and providing an additional seat for the placement of horizontal members of the standard reinforcing grid. It also provides a convenient handle for carrying and positioning the component. A standard anchor bolt 13 is also shown. The upper portion of the wall 10 sits above the pre-cast component, and could be fashioned in combination with the reinforcing grid to be cast as high as the intended structure or site requires.

The sleeves 3 and their corresponding piles 2 are shown at an angle of 40 degrees from vertical, but may be adjusted within a range of 30 to 70 degrees to accommodate varying driven pile configurations and/or traditional wall widths, as varying the angle of the sleeves will alter the width of the passageway between the pre-cast halves. The sleeves have an enlarged upper end to accommodate the cap 3*a*, and this enlargement or other variations in the sleeve diameter or cross section may be incorporated to provide additional functions relative to the driven piles or the placement of the reinforcing elements 5 and/or 5*a*. The piles 2 are driven into the surrounding soil such that their upper ends are in a position immediately below the protective cap 3*a*.

Since the component halves 1i and 1ii containing the sleeves have been pre-cast, a greater degree of quality control is provided than a site pour would allow, creating a smoother interface of the upper end of the sleeve and the concrete facet it is exposed on. This further allows for a better cap fit, and a more reliable, visually appealing finish.

The sleeves 3 are sized according to the diameter of the driven piles 2, allowing a sliding interface with minimal play. They are constructed of a substantially rigid thermoplastic material. Galvanized steel tubes, aluminum, and other alloys or composites may be substituted. In fact, an alternate arrangement is possible where the sleeve itself is removed during the pre-casting process, leaving cavities in the cured cementious material alone through which the piles may be driven. The piles are galvanized steel, but may be stainless steel, other suitable alloys, ceramics or composite materials of appropriate structural character. Finally, the completed assembly is shown resting on a pea gravel bed 14. For some applications, the addition of this material allows for the free flow of site drainage in any direction underneath the foundation system. In some regions, it will also act as a compressible component, allowing frost or clay heaving soils to push upward without transferring a destructive uplifting force on the system. This and other suitable materials, such as common compressible cardboard may be used to provide this function.

EXAMPLE

An example site has wooded vegetation. This vegetation can be cleared with small tracked equipment and dressed or smoothed, generally within the footprint area of the home and driveway only. It can be hydroseeded immediately and even have the topsoil layer placed beforehand. Smoothing means taking care that there are no low spots within the crawl space that would collect water. The site should be smoothed as close to the contours of the natural grade as possible with this one exception.

The next step is to mark out the foundation and lay ⅔" of pea gravel (rounded not crushed) along the outline of the house. In this example, the house has a wood framed floor over a crawl space, with an attached concrete slab floor garage. If the site is considerably sloped, batter boards should be erected to mark out a level and square reference. Rake the gravel smooth, to about 10" wide.

According to a pre-determined plan, the Integrated Precast Footings (IPFs) should be placed at their required spacings, using the wall form boards in between as you go to ensure a tight fit between IPFs. The piles should be placed in the IPFs and set a few inches into the soil, making sure the sides of the IPFs are plumb, and the wall forms make the proper contact with the form seat tabs. (There are raised edges on the side of the IPFs which in this example provide 6" wide guides for the wall form boards.) Before the opposing wall forms are placed, #4 steel reinforcing bar is slipped inside the IPF passageway, resting on the upper and lower reinforcing elements, providing an upper and lower horizontal bar for the subsequent grid. Vertical #4 bars are then tied off at approximately sixteen inches on center, and the corners of the wall are tied and formed in an ordinary fashion. The opposing wall form is then added. The bottom of the wall form is simply staked in place, forcing the wall form against the form seat tabs, and the top of the wall form is held with standard cleats. If you are pouring the wall higher than the top of the IPFs, metal pans are slipped in between the wall forms in the space above the IPFs, and additional wall forms can then be added with more rebar, and conventional form ties, shoes, and cleating. A level line is snapped inside the forms in the typical manner, marking an intended limit to the top of the cementious pour, and step downs, buck outs, anchor bolting, and holdowns are all prepared for embedment in a conventional way.

At this point the builder calls for the single inspection. The inspector can test the take up in piles at this point and ask for any increased length, if necessary, due to soft spots in the soil, and, of course, inspect the bar and forming.

The wall may be poured now, and the piles driven the following week, or the piles may be driven first and then the wall poured. (The second option is faster for construction time, but the driving process can tweak the wall forms out of alignment in certain soils.) Once the piles are driven flush with the tops of the sleeves, rubber caps are set in place over the upper ends of the piles and secured to the sleeves with an appropriate adhesive. The piles are galvanized steel, but may be stainless steel, or any suitable alloy or composite material.

Framing can proceed as soon as the wall forms are stripped, with no drainage systems having to be installed, or backfill to wait for. Surface and subsurface water flows may proceed through the site under the foundation system through the crawlspace soils and out the downhill side uninterrupted. When trenching for utilities parallel to the structure, care should be taken to dig a sufficient distance away from the embedded piles, and to turn toward the house in between the IPFs.

The garage slab is to be poured over 6" of compacted sand or pit run, and a plastic vapor barrier must be used. Care must be taken with the drainage in this area so water doesn't creep under the slab, the same way it is allowed to in the crawl space. Crawl space venting and 6 mil vapor barrier are all conventional. The minimum poured wall using the IPF system is a standard 18" high.

Depending on the site drainage and the landscaping needs, additional bark or well drained topsoil can be brought to the site and banked against the foundation, even up to covering the tops of the IPFs.

Although the invention has been described in detail for the purpose of illustration, it is to be understood that such detail is solely for that purpose and that variations can be made therein by those skilled in the art without departing from the spirit and scope of the invention.

I claim:

1. An assembly component for use in constructing a foundation to an above ground structure, said component comprising:

a first foundation wall coupling spaced from a reciprocal second foundation wall coupling; wherein said spacing provides a volume to be filled with foundation material;

one or more openings in said first and said second foundation wall couplings configured for passage therethrough of one or more piles into the volume to be filled; and reinforcing structural element placed between and connecting said first and second foundation wall couplings, wherein said reinforcing structural element enhances positional retention of said couplings and provides strength to said foundation upon completion, wherein said couplings include inwardly facing surfaces for contact and permanent adhesion with a subsequently added foundation material.

2. An assembly component for use in constructing a foundation to an above ground structure, said component comprising:

a first foundation wall coupling spaced from a reciprocal second foundation wall coupling; wherein said spacing provides a volume to be filled with foundation material;

one or more openings in said first and said second foundation wall couplings configured for passage therethrough of one or more piles into the volume to be filed; and reinforcing structural element placed between and connecting said first and second foundation wall couplings, wherein said reinforcing structural element enhances positional retention of said couplings and provides strength to said foundation upon completion, wherein said couplings are made of foundation material and, in conjunction with said piles and said reinforcing structural element, provide above ground structure load bearing.

3. An assembly component for use in constructing a foundation to an above ground structure, said component comprising:

a first foundation wall coupling spaced from a reciprocal second foundation wall coupling; wherein said spacing provides a volume to be filled with foundation material;

one or more openings in said first and said second foundation wall couplings configured for passage therethrough of one or more piles; and reinforcing structural element placed between and connecting said first and second foundation wall couplings, wherein said reinforcing structural element enhances positional retention of said couplings and provides strength to said foundation upon completion, further comprising one or more reinforcing sleeves for said openings.

4. An assembly component for use in constructing a foundation to an above ground structure, said component comprising:

a first foundation wall coupling spaced from a reciprocal second foundation wall coupling; wherein said spacing provides a volume to be filled with foundation material;

one or more openings in said first and said second foundation wall couplings configured for passage therethrough of one or more piles; and reinforcing structural element placed between and connecting said first and second foundation wall couplings, wherein said reinforcing structural element enhances positional retention of said couplings and provides strength to said foundation upon completion, wherein said reinforcing structural element is rectangular shaped and encircles said piles upon installation.

* * * * *